United States Patent [19]

Filoramo

[11] 4,282,441

[45] Aug. 4, 1981

[54] FILM SAFE

[76] Inventor: Richard F. Filoramo, 1330 Conge, Bloomfield Hills, Mich. 48013

[21] Appl. No.: 54,182

[22] Filed: Jul. 2, 1979

[51] Int. Cl.[3] ..... G21F 1/00

[52] U.S. Cl. ..... 250/515

[58] Field of Search ..... 250/515, 516, 519, 475, 250/482

[56] References Cited

U.S. PATENT DOCUMENTS

| | | | |
|---|---|---|---|
| 3,793,528 | 2/1974 | Takeda | 250/515 |
| 3,845,316 | 10/1974 | Tureck | 250/515 |

*Primary Examiner*—Bruce C. Anderson

*Attorney, Agent, or Firm*—Basile, Weintraub & Hanlon

[57] ABSTRACT

A film safe for protecting photographic film from radiation, moisture and physical damage comprises body and cap portions, each formed of an outer layer of a material having high impact strength and a second layer formed of a radiation impervious material which is adapted to receive an inner layer of a non-metallic or plastic material shaped to surround a roll of photographic film. The body and cap portions engage to form a secure, fluid-tight seal and a continuous radiation impervious barrier around the roll of photographic film. Alternately, thermal insulation is added in a separate layer or in lengthwise extending bores formed in the outer layer of the body portion of the container to protect the photographic film from extreme heat and/or cold conditions.

15 Claims, 4 Drawing Figures

FILM SAFE

BACKGROUND OF THE INVENTION

1. Field of the Invention

This invention relates, in general, to containers for holding photographic film and, more specifically, to containers for holding photographic film that are impervious to electromagnetic radiation and moisture.

2. Description of the Prior Art

It is a daily occurrence in major airports throughout the world for carry-on luggage to be scanned by X-rays so as to determine the contents of luggage in an effort to discourage hijacking of airplanes. However, photographic film and electronic equipment containing transistors are sensitive to such X-ray radiation and are commonly damaged or destroyed by the well-intentioned X-ray search.

As is well known, radiation resistant materials, such as lead, may be interposed between a source of radiation and an object to protect the object from the damaging effects of such radiation. There has also been developed in the prior art various types of leadlined containers to protect photographic film and other radiation sensitive objects from the damaging effects of radiation.

Thus, in U.S. Pat. No. 3,793,528, the gadget bag for a camera includes a space therein for accommodating the camera and film. The space is surrounded by a layer of thermal insulating material and a thin layer of an X-ray resistant material, such as lead, to protect the camera and film from the damaging effects of heat and radiation.

In U.S. Pat. No. 3,845,316, a radiation resistant container is fabricated from laminated sheets of plastic and a radiation impervious material. In the preferred embodiment, the container is fabricated by folding sheets such that the ends are enclosed with at least an overlapping and an abutting inch of the radiation impervious material. The container is held closed by conventional wire bands clasped around the overlapped ends.

Although such radiation resistant containers for holding photographic film and the like provide some degree of radiation protection, they still allow entry of radiation, when abnormal amounts of radiation are produced by improperly set-up or operated baggage search equipment, into the container which causes damage to the film. Since the amount of X-ray output from such baggage search equipment varies substantially from airport to airport, the above-mentioned film containers are ineffective in providing a container that protects photographic film from radiation damage in all situations. Also such film containers possess deficiencies in other areas that further restrict or limit their usefulness.

For one, such devices typically use lead foil, on the order of one to two mils thick, as the radiation resistant material. Such a thin layer affords protection for only small amounts and a small range of wave lengths of radiation, such as those associated with airport baggage check equipment that is properly operated within design parameters. Although it is possible to utilize greater thicknesses of the radiation resistant material such greater thicknesses result in a heavier, bulkier container that is difficult to conveniently carry by itself or in multiple numbers.

For another, such radiation resistant containers are pervious to gas and moisture, which can be just as damaging to film and other sensitive equipment as X-rays.

Since such containers are generally small, they are easily damaged since they are typically thrown in larger containers, such as camera gadget bags or suitcases. Thus, there is a distinct possibility for such containers and their valuable contents to be crushed or inadvertently opened under the vibrations and external forces exerted thereon.

Finally, such containers are offtimes exposed to extreme conditions of heat or cold that can also damage the contents of the container and, particularly, photographic film. Although it is known to provide some type of thermal insulation, as shown in U.S. Pat. No. 3,793,528, such usage of insulation in the prior art has resulted in bulky, difficult to seal containers.

Thus, it would be desirable to provide a film safe or container for protecting photographic film from the damaging effects of electromagnetic radiation which overcomes the problems of prior art radiation resistant containers. It would also be desirable to provide a film safe which, in addition to radiation protection, also protects the photographic film from other external environmental conditions, such as extreme heat and/or cold. It would also be desirable to provide a film safe that maintains the physical integrity of the film despite external forces that may be exerted on the film safe. Finally, it would be desirable to provide a film safe which is easily and quickly adapted to receive at least one standard sized roll of photographic film and, at the same time, which provides a sealable enclosure for the film that is resistant to inadvertant opening.

SUMMARY OF THE INVENTION

There is disclosed herein a film safe suitable for protecting photographic film from moisture, physical damage or the harmful effects of exposure to electromagnetic radiation. The film safe comprises a cap and body portion, each formed of an outer layer of a high impact strength material and a second layer of radiation impervious material disposed in registry with the first layer and which is adapted to receive an inner or third layer of a non-metallic material shaped to surround the roll of photographic film. The body and cap portions are engageable to provide a secure, fluid-tight seal around the photographic film. When the body and cap portions are engaged, the radiation impervious layers in the body and cap portions form a continuous barrier around the photographic film that is impervious to the ingress of electromagnetic radiation.

A film safe constructed according to the teachings of this invention overcomes many of the problems of similar prior art devices since greater thicknesses of radiation impervious material can be utilized without significantly increasing the size of the film safe to thereby provide protection from a wider spectrum of wave lengths and amounts of electromagnetic radiation than previously possible in prior art devices.

In addition, the film safe of this invention uniquely provides a fluid-tight seal capability to protect photographic film from moisture and gases which can be just as damaging to the film as electromagnetic radiation. Finally, the film safe can be easily modified to provide insulation of the film from extreme conditions of heat and/or cold. Lengthwise extending bores are formed in the outer layer of the body portion of the film safe which are filled with suitable insulating material to protect the film from heat and/or cold; which capability has not been effectively provided in the past. Alternately, a fourth layer of insulation of material may be added to the body portion of the film safe to provide the insulation capability to the film safe.

BRIEF DESCRIPTION OF THE DRAWING

The various features, advantages and other uses of this invention will become more apparent by referring to the following detailed description and drawing in which.

DESCRIPTION OF THE PREFERRED EMBODIMENT

Figure 1:
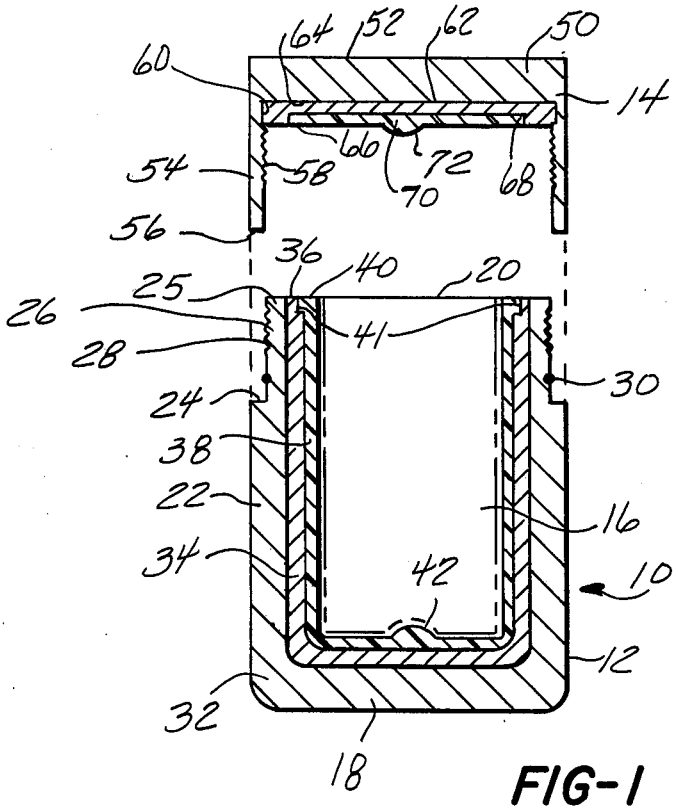
FIG. 1 is a cross sectional view substantially through the center of a film safe constructed according to the teachings of this invention.

Throughout the following description and drawing, identical reference numbers are used to refer to the same component shown in multiple figures of the drawing.

Referring now to the drawing, and to FIG. 1 in particular, there is shown a film safe 10 suitable for protecting photographic film from the damaging effects of moisture and physical damage. The film safe or container 10 comprises a body portion 12 and a cap portion 14 which are engageable to form a secure container around a roll of photographic film shown in phantom at reference number 16.

The thickness of the individual layers of material forming the body and cap portions 12 and 14, respectively, are illustrated slightly out of scale for clarity in depicting the construction of each layer.

The body portion 12 of the container 10 is closed at one end 18 and open at its opposed end 20 to form a hollow, shell-like enclosure. The body portion 12 is formed of a plurality of layers of different materials, each shaped substantially to the shape of the roll 16 of photographic film. Thus, each of the layers of the body portion 12 forms a substantially hollow, shell-like enclosure consisting of a bottom portion, an upstanding side wall portion and an open, opposed end portion. Each layer of the body portion 12 has substantially the same configuration of the outer shape of a standard sized roll 16 of photographic film with only an increased diameter to provide clearance for the inner layers forming the body portion 12 of the container 10.

Although the container 10 is depicted and described hereafter as forming a container for a standard roll of round photographic film, such as 35 mm film, it will be understood that the shape of the container 10 may be modified to handle other film rolls having different configurations, such as cartridge film, which is substantially rectangular in cross section. Thus, since a standard round roll of film has a substantially cylindrical shape and circular cross section, the body and cap portions 12 and 14, respectively, of the container 10 are also formed with a circular cross sectional configuration.

The first or outer layer 22 of the body portion 12 is formed of a suitable material having sufficiently high impact strength to protect the contents of the container from damage and, further, is formed of a material which is capable of being machined or molded with close tolerances to provide the desired fluid-tight seal. Any type of metallic or non-metallic material having the requisite properties may be utilized to form the outer layer 22 of the body portion 12. Thus, non-ferrous metals, such as aluminum or brass, as well as high pressure plastic laminates or hard rubber, may be used to form the outer layer 22. Further, ferrous metals are also useable; however, such metals are susceptable to corrosion or, in the case of stainless steel, are expensive and difficult to machine to the proper tolerances.

Preferably, aluminum is utilized to form the outer layer 22 due to its lightweight and machineability. More particularly, aluminum having a wall thickness of 5/16 inches has been found optimum in providing the required impact strength and lightweight.

The first layer 22 of the body portion 12 is formed with a shoulder or land 24 adjacent to the open end 20 thereof. The land 24 forms a reduced diameter section 26 in the body portion 12 adjacent to the open end 20 of the first layer 22. A plurality of threads 28 are formed on the reduced diameter section 26 of the first layer 22. The threads 28 extend a short distance from the end of the first layer 22 along the reduced diameter section 26, but do not extend the entire length from the open end to the shoulder or land 24. The threads 28 may be any type of thread, such as multiple lead or conventional machine threads. The threads 28 provide one of the means for providing a fluid-tight seal when threadingly engaging corresponding threads in the cap portion 14 of the container 10, as described hereafter.

Additional means are provided for providing a fluid-tight seal between the body and cap portions 12 and 14, respectively, on the container 10. The seal means are carried on the reduced diameter section 26 of the first layer 22 of the body portion 12 and comprise preferably an O-ring 30 which is disposed in a groove, not shown, in the reduced diameter section 26. The O-ring 30 is compressed by the cap 14 as the cap 14 is threaded onto the body portion 12 thereby forming a seal that prevents the ingress of fluids, such as moisture or gasses, into the interior of the container 10.

It should also be noted that the interior edges 32 of the first layer 22 between the side wall portion and the bottom closed end 20 of the first layer 22 are rounded to provide additional strength and, also, to allow the second layer of material forming the body portion 12 to be press fit into registry with the first layer 22.

The second layer 34 of material forming the body portion 12 of the container 10 is formed of a radiation impervious or resistant material. The second layer 34 has substantially the same hollow shell-like configuration and circular cross section as the first layer 22, although slightly smaller in diameter so as to enable the second layer 34 to be disposed in registry with the inside of the first layer 22 of the body portion 12. The second layer 34 is formed of a material that is impervious to electromagnetic radiation so as to block all types of X-rays and other fluroscopic radiation from passing therethrough. Preferably, lead is utilized to form the second layer 34 and, more specifically, lead having a thickness in the range of 0.02 to 0.09 inches, with a 1/16 inch being preferred. The lead is molded or formed from a sheet stock to the desired shell-like configuration with a bottom portion. A side wall portion and an open end portion and is inserted into registry with the first layer 22 of the body portion 12.

The sidewall portion of the second layer 34 has substantially the same length as the sidewall portion of the first layer 22 such that the upper edge 36 of the second layer 34 forms a continuous surface with the upper edge 25 of the first layer 22. Further, the second layer includes an undercut portion 41 adjacent the edge 36 wherein the lip or upper edge of the third layer is disposed, as described hereafter.

The second layer 34 is formed or adapted to receive in registry therewith a third hollow, shell-like layer 38 which surrounds the roll 16 of film. The third layer 38 is typically formed of a suitable non-metallic material, such as plastic, so as to prevent a galvanic reaction between the lead material forming the second layer 34 and the roll 16 of film. Preferably, the third layer 38 comprises the plastic container that a standard sized roll of photographic film is normally purchased in; although a separate layer 38 of a suitable non-metallic or plastic material may also be utilized. As can be seen in FIG. 1, the open end of the third layer 38 has a lip 40. The lip 40 engages the undercut portions 41 of the second layer 34 so as to hold the layer 38 in secure engagement with the second layer 34 within the body portion 12.

The third layer 38 has a substantially small wall thickness, on the order of 5 to 10 mils, and further includes a centering knob 42 which engages a corresponding indentation in the standard roll 16 of photographic film to maintain the roll 16 substantially centered within the container 10. Thus, a standard sized roll 16 of photographic film may be purchased, its plastic cap removed and discarded and its plastic shell which surrounds the roll 16 of film inserted into engagement with the second layer 34 within the body portion 12 of the container 10.

The film safe or container 10 also includes a cap portion 14. The cap portion 14, like the body portion 12, is formed of a plurality of layers of different materials formed in the shape of a hollow, shell-like enclosure. Since the container 10 is described and illustrated in conjunction with a standard sized round roll of photographic film, the cap 14 has a substantially circular cross sectional configuration.

The cap portion 14 includes a first or outer layer 50 preferably formed of the same material, such as aluminum, as the first layer 22 of the body portion 12. The first layer 50 is formed in hollow shell-like configuration with a closed end portion 52 and an upstanding side wall portion 54. The closed end portion 52 has substantially the same wall thickness as the first layer 22 of the body portion 12 to increase the strength of the container 10.

The side wall portion 54 of the cap portion 14 includes a plurality of threads disposed on the interior side thereof adjacent to the edge 56 of the side wall portion 54 so as to readily engage the corresponding threads 28 on the body portion 12 when the cap 14 is threaded onto the body portion 12. The side wall portion 54 of the first layer 50 of the cap portion 14 has a sufficient length from the end 52 such that the edge 56 is in abutting relationship with the land 24 on the body portion 12 when the cap portion 14 is fully engaged with the body portion 12. Finally, the first layer 50 includes an undercut portion 60 wherein the second layer forming the cap portion 14 of the container 10 is inserted.

The cap portion 14 further includes a second layer 62 formed of a radiation impervious material. Preferably, the radiation impervious material forming the second layer 62 is lead having a wall thickness of from 0.02 to 0.09 inches, with a 1/16 inch thickness being preferred. The second layer 62 of the cap portion 14 is formed with a first end portion 64 which is disposed in engagement with the end portion 52 of the first layer 50 when the second layer 62 is inserted within the undercut portion 60 of the first layer 50 and held in engagement therewith. A second end portion 66 of the second layer 62 has a predetermined radial dimension so as to continuously engage the upper edge 36 of the second layer 34 of the body portion 12 when the body and cap portions 12 and 14, respectively, are in full engagement. In this manner, the second layer 62 in the cap portion 14 and the second layer 34 in the body portion 12 abut to form a continuous barrier around the roll 16 of photographic film that is impervious to the ingress of electromagnetic radiation. It should also be noted that the interior of the second layer 62 is recessed or undercut, as shown by reference 68, wherein the third layer 70 of material is disposed.

The third layer of material 70 forming the cap portion 14 of the container 10 is formed of a suitable non-metallic material, such as the same plastic material utilized in the third layer 38 within the body portion 12, so as to prevent a galvanic reaction between the lead and the roll of film. The third layer 70 is formed in a circular disc configuration and is secured or fastened in recess area 68 formed in the second layer 62 of material in the cap portion 14. The third layer 70 also includes a centering knob 72 which engages a protrusion, not shown, on the top of a conventional roll 16 of photographic film thereby, in conjunction with the centering knob 42 on the bottom of the container 10, securely holding the roll 16 of photographic film in place and preventing its movement within the container 10.

Once the roll 16 of photographic film has been inserted within the body portion 12 of the container 10, the cap 14 is threaded onto the body portion 12 until the edge 56 of the cap 14 engages or abutts the land 24 in the top portion of the body portion 12 of the container. As the cap 14 is threaded onto the body 12, the cap 14 compresses and stretches the seal means, such as O-ring 30, thereby forming, in conjunction with the threads 28 and 58 and the close tolerances of the surfaces of the body and cap portions, 12 and 14, respectively, a fluid-tight seal that prevents the ingress of moisture and gases to the interior of the container 10. Further, as mentioned previously, when the body and cap portions 12 and 14, respectively, are in full engagement, the second layers of radiation impervious material 34 and 62 in the body and cap portions 12 and 14, respectively, engage to form a continuous barrier around the roll 16 of photographic film that prevents the ingress of radiation to the interior of the container 10.

It should also be noted that although the container 10 has been described for receiving and containing one standard sized roll 16 of photographic film, it is also within the teachings of this invention to provide a container constructed in the same manner but having increased length or diameter to thereby receive and contain any number of rolls of film. In addition, if it is desired to use a cartridge type of film the outer layers of the container 10 would still preferably have a circular cross section, but of increased diameter with the innermost layer formed in a rectangular cross section such that one or more film cartridges may be inserted within the body of the container 10. In either case, the construction and materials used to form the layers of the container 10 would be the same despite the different dimensions necessary for use with other sized and shaped rolls of photographic film.

Figure 2:
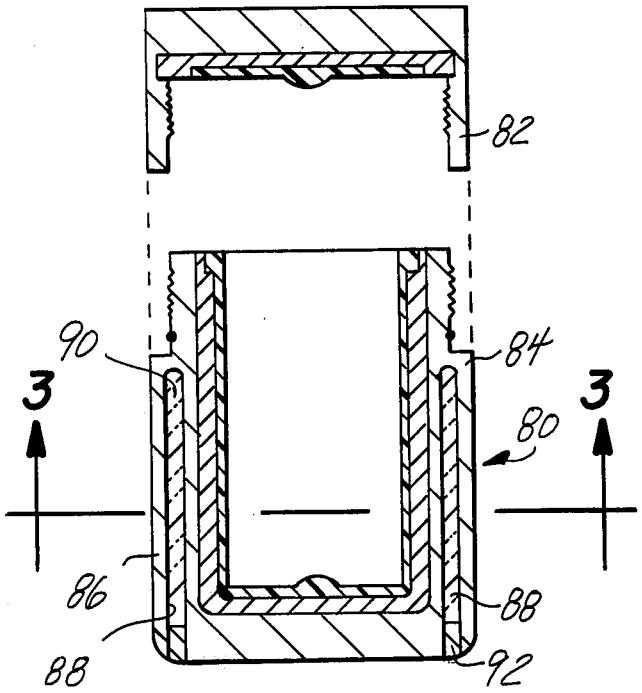
FIG. 2 is a central cross sectional view of another embodiment of the film safe of this invention.
Figure 3:
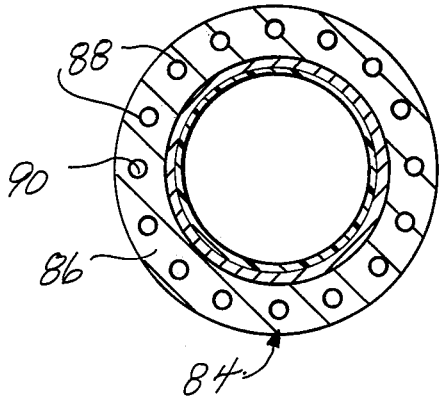
FIG. 3 is a sectional view, generally taken along line 3—3 in FIG. 2, showing bores formed in the outer layer of the body portion of the film safe for use with insulating material.

Referring now to FIGS. 2 and 3, there is shown another embodiment of this invention wherein a film safe 80 includes means for insulating the photographic film contained therein from external conditions, such as heat and/or cold. The container 80 comprises a cap portion 82 which is identical to the cap portion 14 of the container 10 shown in FIG. 1 and described above. The container 80 further includes a body portion 84 which is constructed with the same materials, dimensions and features as the body portion 12 of the container 10 shown in FIG. 1, with the addition of the insulating means. According to this embodiment, the insulating means comprise at least one lengthwise extending bore or slot 88, which is formed in the outer layer 86 of the body portion 84. Alternately, other construction methods may be utilized to form one continuous slot around the entire or outer layer 86 or in just a portion of the outer layer 86 of the body portion 84.

According to the preferred embodiment, a plurality of bores 88 are preferably formed in the outer layer 86, such as by drilling each bore from the bottom of the outer layer 86. The bores have a relatively small diameter, such as ⅛ inch, and are equi-distantly spaced around the outer layer 86 of the container 80 which is adapted to receive a standard sized roll of photographic film. The number of bores and the diameter of each bore are chosen to provide adequate strength for crushproof resistance in the outer layer 86 while, at the same time, providing adequate space for sufficient quantities of insulation material to protect the photographic film from extreme heat and/or cold conditions.

The insulating capability is achieved by disposing an insulation material 90 within each of the bores 88 in the outer layer 86 of the container 80. After the insulating material 90 has been disposed within each bore 88, a plug 92 preferably formed of the same material forming the outer layer 86, such as aluminum, is inserted into the end of the bore 88 to seal or otherwise maintain or hold the insulating material 90 therein.

According to one embodiment, when it is desirous to protect the photographic film from extreme conditions of heat or high temperatures, the insulating means 90 disposed within the bores 88 comprises a solution that may be frozen prior to the insertion of the film within the container 80. When the container 80 is then exposed to the high temperatures, the solution slowly melts thereby absorbing the external heat and protecting the film from high temperatures. Examples of insulating materials that provide such capability include water or conventional anti-freeze type solutions.

If the user expects the container 80 to experience low or cold temperature conditions, standard thermal insulation materials, such as asbestos or fiberglass, may be inserted within the bores 88 to provide protection from the extreme cold or low temperatures. It is also evident that the use of such thermal insulating materials provides some heat protection also and, therefore, may be utilized to provide both heat and cold protection for the photographic film.

Figure 4:
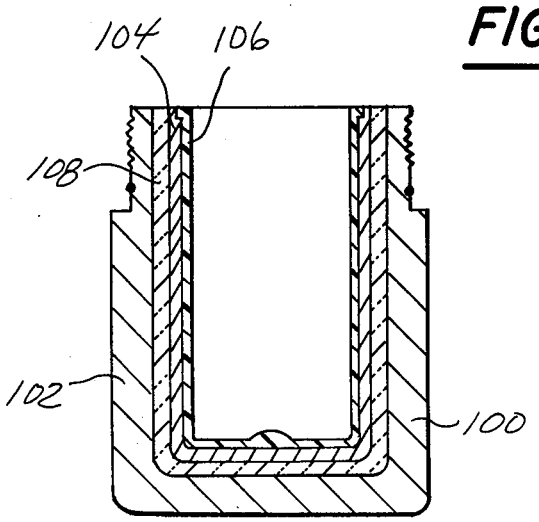
FIG. 4 is a cross sectional view substantially through the center of the film safe showing another embodiment of this invention.

Alternately, the same insulating capability may be provided through the use of an additional fourth layer of insulating material instead of utilizing the bores 88, as shown in FIG. 4. As shown therein, a body portion 100 of the film safe is formed similarly to that described above but with increased diameter for the addition of the fourth layer of material therein. The body portion 100 includes a first or outer layer 102 formed of a high impact strength material and including the same external threads, seal means and reduced diameter end portion as the container 100 shown in FIG. 1 and described above. The body portion 100 further includes an inner second layer 104 of a radiation impervious material adapted to receive a third layer 106 of a plastic material which surrounds a roll of photographic film not shown.

According to this embodiment of the invention, a fourth layer 108 of insulating material is disposed between two of the layers of material forming the body portion 100. The insulating material may be any standard type of insulation, such as asbestos, cottonfiber, or fiberglass, which can be formed to the shell-like configuration of the body portion of the film safe. For best thermal insulating characteristics, the layer of insulating material 108 is disposed between the first and second layers 102 and 104 to thereby prevent metal to metal contact between the first and second layers. However, it is also possible to dispose the fourth layer 108 of insulating material between the second and third layers 104 and 106, respectively, or around the entire outer periphery of the body portion 100 of film safe. In either case, the additional layer of insulating material provides sufficient thermal insulation to protect the roll of photographic film disposed within the container from extreme conditions of heat and/or cold.

In summary, there has been disclosed herein a new and improved film safe suitable for protecting photographic film from damage due to moisture, physical damage or exposure to electromagnetic radiation. The film safe includes body and cap portions, each formed of an outer layer of a high impact strength material and a second inner layer of a radiation impervious material which is adapted to receive a third innermost layer of a non-metallic material which has substantially the same configuration as a standard sized roll of photographic film. The body and cap portions are engageable to provide a secure, fluid-tight seal around the photographic film. When the body and cap portions are in full engagement, the layers of radiation impervious material in each of the body and cap portions engage to form a continuous barrier around the photographic film that is impervious to the ingress of radiation. Alternately, additional insulation material may be disposed in bores formed in the outer layer of the body portion of the container or in a separate layer to protect the photographic film from extreme conditions of heat and/or cold.

What is claimed is:

1. A film safe for containing photographic film comprising:

a body portion; and a cap portion;

said body portion being open at one end and closed at the opposed end to form a hollow enclosure, said body portion comprising;

a first outer layer; and a second layer disposed in registry with said first layer, said second layer being formed of a radiation impervious material;

said second layer being adapted to receive in registry therewith a third innermost layer for holding a roll of photographic film;

said cap portion being open at one end and closed at the opposed end to form a hollow enclosure, said cap portion comprising;

a first outer layer;

a second layer of radiation impervious material disposed in registry with the first layer; and a third layer of a non-metallic material disposed in registry with said second layer;

said body and cap portions being engageable in a fluid-tight sealing relationship and, further, when said body and cap portions are engaged, said second layers of radiation impervious material in said body and cap portions form a continuous radiation impervious barrier around the interior of said film safe to prevent radiation from entering therein.

2. A film safe for containing photographic film comprising:

a body portion; and a cap portion;

said body portion being open at one end and closed at the opposed end to form a hollow enclosure, said body portion comprising;

a first outer layer, said first layer of said body portion including a plurality of threads on the exterior surface thereof adjacent to said open end thereof; and a second layer disposed in registry with said first layer, said second layer being formed of a radiation impervious material;

said second layer being adapted to receive in registry therewith a third innermost layer for holding a roll of photographic film;

said cap portion being open at one end and closed at the opposed end to form a hollow enclosure, said cap portion comprising;

a first outer layer, said first layer of said cap portion including a plurality of threads on the interior surface thereof adjacent to said open end such that said body and cap portions are threadingly engageable;

a second layer of radiation impervious material disposed in registry with said first layer; and a third layer of non-metallic material disposed in registry with said second layer;

said body and cap portions being engageable so as to form a fluid-tight seal therebetween and, further, when said body and cap portions are engaged, said second layers of radiation impervious material in said body and cap portions form a continuous radiation impervious barrier around the interior of said film safe to prevent radiation from entering therein.

3. The film safe of claim 1 further including means carried by said body portion for forming a fluid-tight seal when said body and cap portions are engaged.

4. A film safe for containing photographic film comprising:

a body portion;

a cap portion;

said body portion being open at one end and closed at the opposed end to form a hollow enclosure, said body portion comprising;

a first outer layer; and a second layer disposed in registry with said first layer, said second layer being formed of a radiation impervious material;

said second layer being adapted to receive in registry therewith a third innermost layer for holding a roll of photographic film;

said cap portion being open at one end and closed at the opposed end to form a hollow enclosure, said cap portion comprising;

a first outer layer;

a second layer of radiation impervious material disposed in registry with the first layer; and a third layer of non-metallic material disposed in registry with said second layer; and means carried by said body portion for forming a fluid-tight seal between said body and cap portions, said seal means including an O-ring disposed on the exterior of said first layer of said body portion adjacent to said open end thereof so as to be disposed between said first layers of said body and cap portions when the same are threadingly engaged;

said body and cap portions being engageable so as to form a fluid-tight seal therebetween and, further, when said body and cap portions are engaged, said second layers of radiation impervious material in said body and cap portions form a continuous radiation impervious barrier around the interior of said film safe to prevent radiation from entering therein.

5. A film safe for containing photographic film comprising:

a body portion;

a cap portion;

said body portion being open at one end and closed at the opposed end to form a hollow enclosure, said body portion comprising;

a first outer layer; and a second layer disposed in registry with said first layer, said second layer being formed of a radiation impervious material;

said second layer being adapted to receive in registry therewith a third innermost layer for holding a roll of photographic film;

said cap portion being open at one end and closed at the opposed end to form a hollow enclosure, said cap portion comprising;

a first outer layer;

a second layer of radiation impervious material disposed in registry with the first layer; and a third layer of a non-metallic material disposed in registry with said second layer;

said first layer of said body portion including a plurality of threads on the exterior surface thereof adjacent to the open end thereof;

said first layer of said cap portion including a plurality of threads on the interior surface thereof adjacent to the open end such that said body and cap portions are threadingly engageable; and means carried by said body portion for forming a fluid-tight seal between said body and cap portions;

said body portion having a reduced diameter section adjacent said open end thereof, said reduced diameter section carrying said external threads and said seal means thereon;

said body and cap portions being engageable so as to form a fluid-tight seal therebetween and, further, when said body and cap portions are engaged, said second layers of radiation impervious material in said body and cap portions form a continuous radiation impervious barrier around the interior of said film safe to prevent radiation from entering therein.

6. The film safe of claim 1 wherein the second layers of material of the body portion has a thickness in the range of from 0.02 to 0.09 inches.

7. The film safe of claim 1 wherein the second layers of the body and cap portions have predetermined lengths such that the ends of said second layers are disposed in registry when said body and cap portions are engaged to form a continuous radiation impervious barrier around the interior of said film safe.

8. The film safe of claim 1 wherein the third layer in the body portion is the container normally associated with the purchase of a roll of photographic film.

9. A film safe for containing photographic film comprising:

a body portion; and a cap portion;

said body portion being open at one end and closed at the opposed end to form a hollow enclosure, said body portion comprising;

a first outer layer; and a second layer disposed in registry with said first layer, said second layer being formed of a radiation impervious material;

said second layer being adapted to receive in registry therewith a third innermost layer for holding a roll of photographic film;

said cap portion being open at one end and closed at the opposed end to form a hollow enclosure, sid cap portion comprising;

a first outer layer;

a second layer of radiation impervious material disposed in registry with the first layer; and a third layer of a non-metallic material disposed in registry with said second layer; and wherein said first layer of material in said body and cap portions is formed of aluminum, said second layer of material in said body and cap portions is formed of lead and said third layer of material in said body and cap portions is formed of a plastic material;

said body and cap portions being engageable so as to form a fluid-tight seal therebetween and, further, when said body and cap portions are engaged, said second layers of radiation impervious material in said body and cap portions form a continuous radiation impervious barrier around the interior of said film safe to prevent radiation from entering therein.

10. The film safe of claim 1 further including means for insulating the contents of said film safe from the external environment.

11. A film safe for containing photographic film comprising:

a body portion;

a cap portion;

said body portion being open at one end and closed at the opposed end to form a hollow enclosure, said body portion comprising;

a first outer layer; and a second layer disposed in registry with said first layer, said second layer being formed of a radiation impervious material;

said second layer being adapted to receive in registry therewith a third innermost layer for holding a roll of photographic film;

said cap portion being open at one end and closed at the opposed end to form a hollow enclosure, said cap portion comprising;

a first outer layer;

a second layer of radiation impervious material disposed in registry with the first layer; and a third layer of a non-metallic material disposed in registry with said second layer;

said body and cap portions being engageable so as to form a fluid-tight seal therebetween and, further, when said body and cap portions are engaged, said second layers of radiation impervious material in said body and cap portions form a continuous radiation impervious barrier around the interior of said film safe to prevent radiation from entering therein; and means for insulating the contents of said film safe from the external environment, said insulating means comprising:

a lengthwise extending bore disposed in said first layer of said body portion of said film safe; and a thermal insulating material disposed within said bore for protecting the contents of said film safe from extreme conditions of heat and/or cold.

12. The film safe of claim 11 wherein the insulating material is a liquid material adapted to be frozen prior to insertion of the photographic film into said film safe such that the heat from the external environment is absorbed by said insulating material thereby melting said insulating material and protecting the film from such heat.

13. The film safe of claim 11 wherein the insulating material disposed in the bore is a thermal insulating material for protecting the contents of said film safe from extreme low temperatures.

14. The film safe of claim 10 wherein the insulating means comprises a fourth layer of insulative material in the body portion of said film safe to provide a thermal insulative barrier between the interior of said film safe and the external environment.

15. The film safe of claim 14 wherein the fourth layer of insulative material is disposed between the first and second layers of material in the body portion of said film safe.

* * * * *

UNITED STATES PATENT AND TRADEMARK OFFICE

CERTIFICATE OF CORRECTION

PATENT NO. : 4,282,441

DATED : August 4, 1981

INVENTOR(S) : Richard Filoramo

It is certified that error appears in the above-identified patent and that said Letters Patent are hereby corrected as shown below:

On the cover sheet, item (76), delete "1330 Conge, Bloomfield Hills, Mich. 48013" and insert --2478 Pembroke, Birmingham, Mich. 48008--.

Column 11, line 21, delete "sid" and insert --said--.

Signed and Sealed this

*Third* Day of *November 1981*

[SEAL]

*Attest:*

GERALD J. MOSSINGHOFF

*Attesting Officer*

*Commissioner of Patents and Trademarks*